United States Patent [19]

McCollough

[11] 4,269,529

[45] May 26, 1981

[54] PEN WITH ARTICULATE HANDLE

[76] Inventor: John D. McCollough, 10715 Rochester Ave., Los Angeles, Calif. 90024

[21] Appl. No.: 959,762

[22] Filed: Nov. 13, 1978

[51] Int. Cl.[3] ..... B43K 1/10

[52] U.S. Cl. ..... 401/258; 401/6

[58] Field of Search ..... 401/6, 7, 48, 195, 258, 401/259, 260; 15/443, 444, 445

[56] References Cited

U.S. PATENT DOCUMENTS

| | | | |
|---|---|---|---|
| 1,528,142 | 3/1925 | Bourquin | 401/259 |
| 2,996,044 | 8/1961 | Parker | 401/6 |
| 3,055,341 | 9/1962 | Riepe | 401/258 X |
| 3,418,058 | 12/1968 | Gossel | 401/195 X |
| 3,824,022 | 7/1974 | Bancino | 401/6 |
| 4,076,427 | 2/1978 | Anderson | 401/6 |

FOREIGN PATENT DOCUMENTS

| | | | |
|---|---|---|---|
| 572506 | 10/1958 | Belgium | 401/258 |
| 802054 | 12/1950 | Fed. Rep. of Germany | 401/260 |

OTHER PUBLICATIONS

"Dieterich-Post Company Catalog 1960-1961", p. 160.

*Primary Examiner*—Edward M. Coven
*Attorney, Agent, or Firm*—Fulwider, Patton, Rieber, Lee & Utecht

[57] ABSTRACT

A writing instrument, particularly a technical fountain pen, has a handle with finger grips that can be adjusted to a desired position while the point is maintained in a predetermined orientation with respect to the writing surface. The finger grips permit the handle to be readily held against twisting in the hand of the user.

1 Claim, 6 Drawing Figures

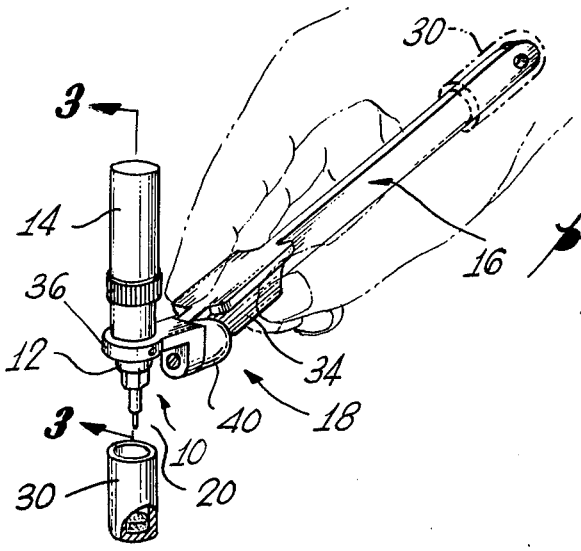
Fig. 1
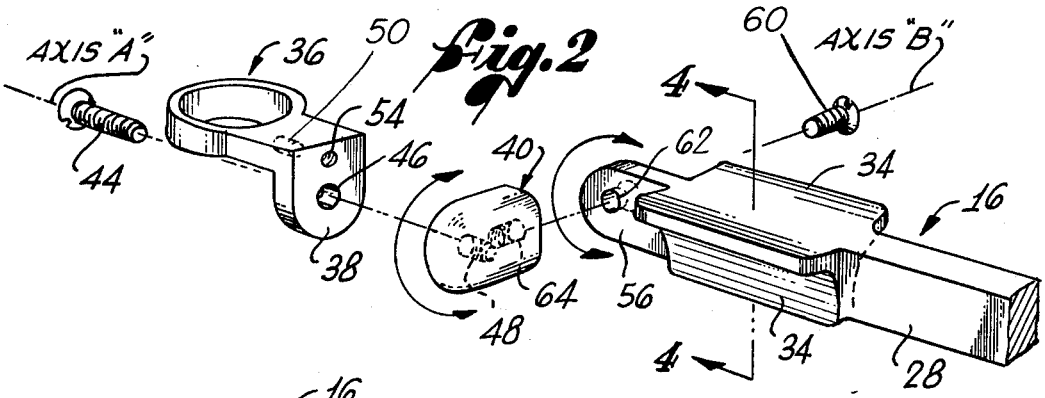
Fig. 2
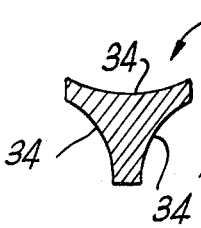
Fig. 4
Fig. 3
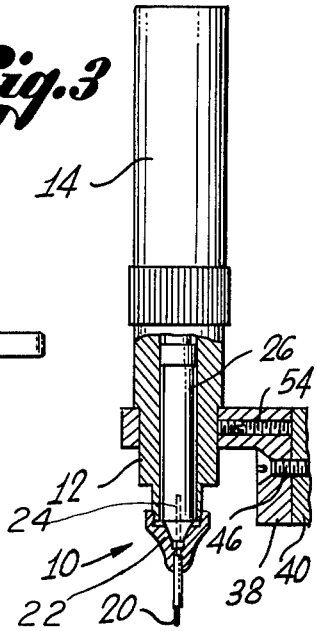
Fig. 5
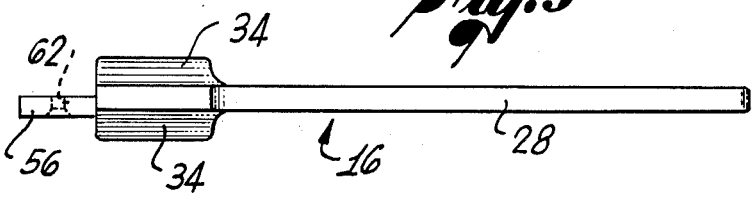
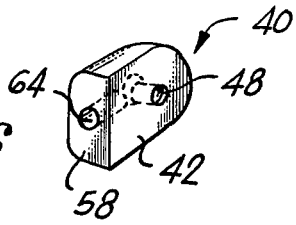
Fig. 6

PEN WITH ARTICULATE HANDLE

BACKGROUND OF THE INVENTION

The present invention relates to writing instruments and, more particularly, to pens which function best when the writing point is maintained in a predetermined orientation with respect to a writing surface.

Most conventional pens intended for free-hand writing will tolerate a relatively wide range of angular positions with respect to a writing surface without varying their performance to an extent that is objectionable to the average user. For more precise and demanding work or more particular users, however, the orientation of the point with respect to the writing surface can take on considerable importance.

One type of pen that has superior performance characteristics is the so-called "technical" fountain pen which is characterized by a passage through which ink is delivered to the point and by a weighted wire that reciprocates within the passage. The motion of the wire within the pen keeps the ink flowing smoothly. The point of this type of pen terminates in a hollow tubular member, sometimes referred to as a writing tip, but is, nevertheless, considered a point as that term is used herein. An exemplary technical pen is described in U.S. Pat. No. 3,418,058 issued to E. H. Gossel on Dec. 24, 1968.

Technical pens are frequently used for non-free hand writing, as in plotting machines and mechanical lettering devices, in which the point is held perpendicular to the writing surface at all times. It has been found that the performance of these pens is noticeably affected in a disadvantageous manner when they are used for free-hand writing and the angle the point makes with a horizontal writing surface varies.

Arrangements have been proposed or manufactured to deal with the problem of point angle, but none has been entirely satisfactory. Some pens attach the point at an acute angle to the pen handle with the intention of allowing the point to remain perpendicular to the writing surface. A somewhat better solution has been to provide for adjustment of the angle between the point and the handle, employing a pivot joint. In either case, however, the vertical point and the collar or structure by which the point is attached can apply a torque to the handle, causing the entire pen to have a tendency to turn in the hand of the writer. If the pen is allowed to turn, it results in the creation of an angle between the point and the writing surface in another plane and to that extent does not accomplish its purpose. To hold the pen tightly enough to prevent it from turning is often awkward and difficult.

It is an objective of the present invention to provide a pen or other writing instrument for free-hand writing which overcomes the above deficiencies of previously known pens, allowing adjustment of the handle to a position most comfortable for an individual user and preventing the pen from turning in the hand.

SUMMARY OF THE INVENTION

The present invention resides in a writing instrument having a writing point mounted in a collar and an articulate handle adjustably connected to the collar. Finger grips on the handle permit it to be held firmly against rotation when used for free handwriting. The rotational position of the finger grips can be adjusted in accordance with the preference of an individual user to achieve an optimum pen holding position.

In a preferred arrangement, the connection of the handle to the collar permits relative adjustment of the handle about two axes so that the point can be maintained in a predetermind orientation with respect to the writing surface independently of the position of the handle and finger grips. The invention is most advantageously used with a technical pen to obtain maximum benefit from its adjustability feature.

The adjustable connection includes a bracket immovably attached to the collar and a movable connection member, the bracket and connection member having opposed faces that permit sliding rotational movement between them. A second face of the connection member opposes a face of the handle to permit sliding rotation of the handle relative to the connection member about another axis. The bracket, connection member and handle can be fixed in the desired relative positions by adjustment screws received in bores that extend through the opposing faces. For best results, the bores should be perpendicular to each other and the two sets of opposing surfaces should be perpendicular to each other.

It is desirable to provide three finger grips on the handle, each formed by a concave surface so the pen can be held securely by the thumb, forefinger and second finger.

Other features and advantages of the present invention will become apparent from the following detailed description, taken in conjunction with the accompanying drawings, which illustrate, by way of example, the principles of the invention.

BRIEF DESCRIPTION OF THE DRAWINGS

FIG. 1 is a perspective view of an exemplary technical pen constructed in accordance with the invention, the hand of a user gripping the pen being shown in phantom lines;

FIG. 2 is an enlarged, exploded, perspective view of the adjustable joint and a fragementary portion of the handle of the pen;

FIG. 3 is an enlarged partially broken-away, fragmentary, side elevation of the pen;

FIG. 4 is a cross-sectional view of the handle taken along the line 4—4 of FIG. 2;

FIG. 5 is an enlarged bottom view of the handle; and

FIG. 6 is an enlarged perspective view of the connection member, its position being inverted to show the sides that are hidden in FIG. 2;

DESCRIPTION OF THE PREFERRED EMBODIMENT

Figure 7:
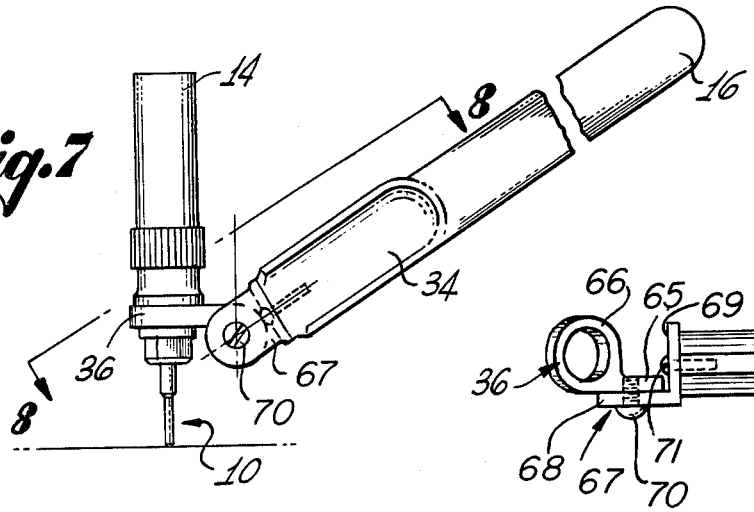
Figure 8:
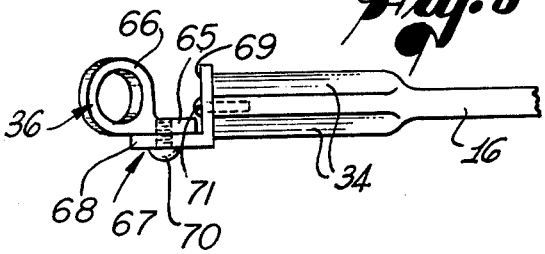
Figure 9:
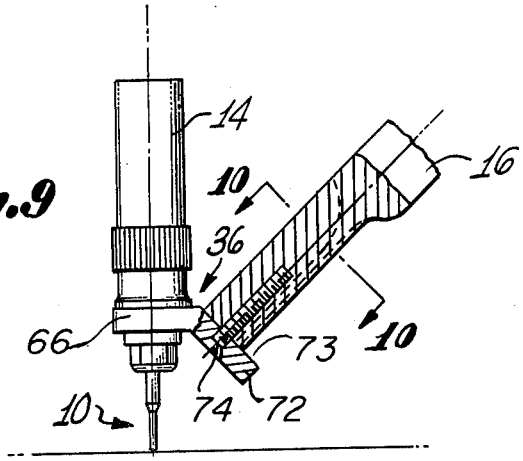
Figure 10:
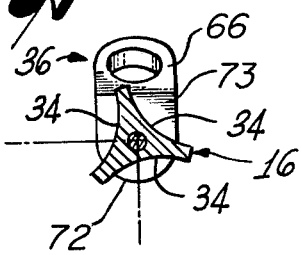
Figure 11:
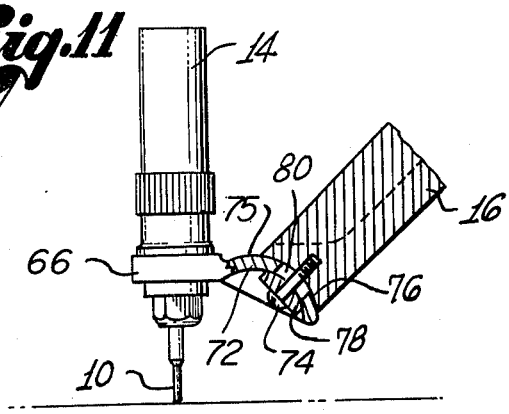
Figure 12:
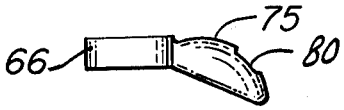

An exemplary fountain pen of the technical type, shown in FIGS. 1–6 of the accompanying drawings, includes a writing point 10, a collar 12 in which the point is mounted, an ink reservoir 14 supported above the collar, a handle 16, and an adjustable connection 18 between the collar and the handle.

The point 10 (best shown in FIG. 3) is generally of the construction described in the afore-mentioned U.S. Pat. No. 3,418,058, including a thin tubular tip 20 that actually contacts the writing surface and a larger plastic insert 22 in which a weight and cleaning wire assembly 24 reciprocates in a vertical ink passage 26 to promote a smooth and even flow of ink delivered to the writing surface. The term "point", as used herein, encompasses the plastic insert 22 along with the tubular member 20 since these parts are conventionally sold as a single replaceable unit. Since the details of the point construction are known to those skilled in the art, they are not set forth here. It will be understood that a variety of points of this general type are known and readily available, and such points other than that described in the above-mentioned patent could be selected for use in the present invention.

The insert 22 of the point 10 is received by the tubular collar 12 and the refillable ink reservoir 14 is mounted atop the collar 12 in communication with the ink delivery passage 26. As explained above, a pen of this type performs best when the point 10, collar 12 and reservoir 14 maintain a generally vertical orientation, perpendicular to a horizontal writing surface.

The handle 16 includes an elongated shaft 28 of rectangular cross-section, as best shown in FIGS. 1, 2 and 5. A cylindrical cup-shaped cap 30 that normally fits over the point 10 (shown in solid lines in FIG. 1) can be placed on the top end of the shaft 28 when the pen is not in use (as shown in phantom lines in FIG. 1). At the bottom of the cap 30 is a layer 32 of soft gum-like material in which the point 10 is received to keep it from drying out when the cap is in place.

Near the lower end of the handle 16 are three finger grips, each formed by a concave surface 34, as best shown in FIG. 4. These surfaces 34 are positioned in a triangular arrangement on the top and two sides of the shaft 28 to accommodate the thumb, forefinger and second finger of the writing hand (as shown in FIG. 1). Since ink does not flow through the handle 16, the configuration and position of the grips 34 and the overall shape of the handle is not restricted by functional requirements other than those relating to holding the pen.

The adjustable connection 18 (best shown in FIG. 2) includes a ring-shaped bracket 36 that slidably receives the collar 12. The bracket 36 carries a flat, normally vertical face 38 on one side parallel to the longitudinal axes of the point 10 and the collar 12. If desired, the bracket 36 could be integrally formed with the collar 12, its essential function being to provide the face 38. A connection member in the form of a block 40 (FIGS. 2 and 6) has a first, flat, normally vertical connection face 42 opposing the bracket face 38 and a first adjustment screw 44 extends through a normally horizontal bracket bore 46 that opens into the bracket face 38 and into a threaded bore 48 in the first connection face 42. Thus the connection block 40 can be rotated about the longitudinal axis "A" of the adjustment screw 44 while the opposed faces 38 and 42 slide on each other until the block assumes the desired position with respect to the bracket 36. A set screw 50 extends through an adjacent bore 54 in the first bracket face 38 and bears against the connection block 40 to further secure the block once the desired position has been reached.

On the lower end of the handle 16, below the finger grips 34, is a flat handle face 56 that opposes a second face 58 of the connection block 40. A second adjustment screw 60 extends through an opening 62 in the handle 16 into a second threaded bore 64 in the connection block 40 that opens into the second connection block face 58. Thus the handle 16 can be rotated on the longitudinal axis "B" of the second adjustment screw 52 while the second set of opposing faces 56 and 58 slide on each other. Upon tightening of the second adjustment screw 60, the handle 16 can be secured in the desired position.

The first and second faces 42 and 58 of the connecting block 40 are perpendicular to each other as are the connection block bores 48 and 64. It is therefore possible to rotate or pivot the handle 16 in two perpendicular directions by changing the position of the connection block 40 relative to the bracket 36 or the position of the handle itself relative to the block. By selecting the proper combination of these two adjustments, the handle 16 can assume any desired angle relative to the writing surface and the finger grips 34 can be made to revolve about the longitudinal axis of the handle 16 to independently assume the most comfortable position.

It will be apparent from the foregoing that the present invention provides a writing instrument that has a maximized ability to adapt to the optimum writing position of the individual user while the point is maintained in the most effective orientation. At the same time, it can be gripped firmly without uncomfortable pressure against the handle to prevent the pen from twisting. While a particular form of the invention has been illustrated and described, it will also be apparent that various modifications can be made without departing from the spirit and scope of the invention.

I claim:

1. In a pen of the technical type for free-hand writing having a point, a collar in which said point is mounted, an ink passage extending to said point, a weight and wire assembly reciprocably disposed within said passage, and an ink reservoir disposed above said collar and extending upwardly therefrom in communication with said passage, wherein the improvement comprises:

a bracket attached to said collar and having a normally vertical bracket face thereon and a normally horizontal bracket bore opening into said bracket face;

a connection block having first and second perpendicular connection faces and having first and second perpendicular connection block bores opening into said first and second connection faces, respectively, said first connection face opposing said bracket face to permit sliding, rotational, relative movement;

first adjustment screw means received by said bracket bore and said first connection block bore for holding said connection block in a fixed position relative to said bracket;

an elongated handle having three concave finger grip surfaces and thereby adapted to be held in a selected orientation by the hand of a user, a handle face opposing said second connection face to permit sliding, rotational, relative movement between said handle and said connection block, and a handle bore opening into said handle face; and a second adjustment screw means received by said handle bore and said second connection block bore for holding said handle in a fixed position relative to said connection block, whereby said point can be maintained in a predetermined orientation with respect to a writing surface independently of the orientation of said handle and finger grips.

* * * * *